US008231471B2

(12) United States Patent
Blackburn et al.

(10) Patent No.: US 8,231,471 B2
(45) Date of Patent: Jul. 31, 2012

(54) AUTOMATED WAGERING GAME MACHINE CONFIGURATION AND RECOVERY

(75) Inventors: Christopher W. Blackburn, Reno, NV (US); Robert T. Davis, Reno, NV (US); Christopher J. Frattinger, Sparks, NV (US)

(73) Assignee: WMS Gaming, Inc., Waukegan, IL (US)

( * ) Notice: Subject to any disclaimer, the term of this patent is extended or adjusted under 35 U.S.C. 154(b) by 7 days.

(21) Appl. No.: 13/054,994

(22) PCT Filed: Jul. 21, 2009

(86) PCT No.: PCT/US2009/051327

§ 371 (c)(1),
(2), (4) Date: Jan. 20, 2011

(87) PCT Pub. No.: WO2010/019356

PCT Pub. Date: Feb. 18, 2010

(65) Prior Publication Data

US 2011/0124406 A1 May 26, 2011

Related U.S. Application Data

(60) Provisional application No. 61/082,628, filed on Jul. 22, 2008.

(51) Int. Cl.
*A63F 9/24* (2006.01)

(52) U.S. Cl. ..... 463/42; 463/24; 463/29

(58) Field of Classification Search ..... 463/29, 463/42

See application file for complete search history.

(56) References Cited

U.S. PATENT DOCUMENTS

| | | | |
|---|---|---|---|
| 2007/0060302 | A1 | 3/2007 | Fabbri |
| 2007/0155490 | A1 | 7/2007 | Phillips et al. |
| 2008/0045346 | A1 | 2/2008 | Nelson et al. |
| 2008/0064501 | A1 | 3/2008 | Patel |
| 2008/0108405 | A1 | 5/2008 | Brosnan et al. |

FOREIGN PATENT DOCUMENTS

WO WO2010019356 2/2010

OTHER PUBLICATIONS

"PCT Application No. PCT/US09/51327 International Preliminary Report on Patentability", Mar. 28, 2011 , 14 pages.
"PCT Application No. PCT/US09/51327 International Search Report", Jan. 7, 2010 , 9 pages.

*Primary Examiner* — Omkar Deodhar
(74) *Attorney, Agent, or Firm* — DeLizio Gilliam, PLLC

(57) ABSTRACT

A wagering game system and its operations are described herein. In embodiments, the operations can include determining one or more casino events that request a configuration for one or more wagering game machines, generating one or more automated configuration tasks, assigning one or more properties to the tasks, and storing the one or more automated configuration tasks and the one or more properties so that the one or more properties are persisted on the gaming network. The operations can also include recovering a wagering game machines operational state if the automated configuration tasks encounter problems during execution that affect the wagering game machines playability.

25 Claims, 8 Drawing Sheets

AUTOMATED WAGERING GAME MACHINE CONFIGURATION AND RECOVERY

RELATED APPLICATIONS

This application claims the priority benefit of U.S. Provisional Application Ser. No. 61/082,628 filed Jul. 22, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems, and more particularly to devices and processes that automatically configure and recover gaming network devices, including wagering game machines.

BACKGROUND

Casinos must maintain numerous devices on a gaming network. Some of those devices include wagering game machines. Wagering game machines are devices on a gaming network that can provide wagering games to casino patrons. The wagering game machines rely on other devices to support them, including wagering game servers, progressive game servers, account servers, network communication devices, etc. All of the elements of the gaming network may be referred to collectively as a wagering game system ("system"). The devices on the system may require constant updates, downloads and other maintenance activities ("configurations"), to keep them in proper working order, to update software and games, to optimize performance, etc. Casinos, however, are faced with significant challenges configuring their many devices. Some examples of those challenges include minimizing the costs of employing device technicians, managing downtime of wagering game machines, tracking system performance, avoiding network communication errors, etc.

SUMMARY

In some embodiments, a method comprises determining one or more casino events that indicate a configuration change for one or more wagering game machines; generating one or more automated configuration tasks based on the one or more casino events; and storing the one or more automated configuration tasks in a persistent data store so that the one or more wagering game machines can access the one or more automated configuration tasks.

In some embodiments, the casino events include one or more of instances of wagering game application activity, wagering game device configuration settings, and wagering game machine status information.

In some embodiments, generating the one or more automated configuration tasks comprises determining wagering game content from a primary wagering game server; determining additional wagering game content from one or more gaming network devices including one or more of a secondary wagering game server, a bonus server, a progressive game server, a tournament server, a licensing server, and a compatibility server; and generating the one or more automated configuration tasks to include installation of both the wagering game content and the additional wagering game content on the one or more wagering game machines.

In some embodiments, the method further comprises executing the one or more automated configuration tasks; and updating the persistent data store with status information concerning the one or more automated configuration tasks.

In some embodiments, the method further comprises presenting the one or more automated configuration tasks on a user interface task list to be executed in order; and presenting one or more of the status information and tasks controls on the task list.

In some embodiments, storing the one or more tasks further comprises: assigning one or more or properties and data to the one or more automated configuration tasks; storing the one or more of properties and data in the persistent data store; and tracking the automated configurations tasks using the one or more of properties and data.

In some embodiments, storing the one or more automated configuration tasks includes storing the one or more automated configuration tasks on one or more of a file system, a relational database, a flat file system, a data repository, a hard disk, and a non-volatile memory storage unit.

In some embodiments, one or more machine-readable media having instructions stored thereon, which when executed by a set of one or more processors causes the set of one or more processors to perform operations comprises generating one or more configuration backup files for a wagering game machine, wherein the one or more configuration backup files provide a playable state for the wagering game machine; executing one or more automated configuration tasks to automatically update the wagering game machine's configuration state; determining one or more problems with executing the one or more automated configuration tasks, wherein the one or more problems create a non-playable state on the wagering game machine; and restoring the wagering game machine to a playable state using the one or more configuration backup files.

In some embodiments, the operations further comprises: modifying the one or more automated configuration tasks to compensate for the one or more problems resulting in modified configuration tasks; and executing the modified configuration tasks.

In some embodiments, the operations further comprises determining that an expiration period has not expired for the one or more automated configuration tasks; determining that one or more regulatory gaming restrictions have been met regarding wagering game configurations; and re-executing one or more of the one or more automated configuration tasks.

In some embodiments, the operations further comprises storing the one or more automated configuration tasks in a database in both a human readable format and in a binary format.

In some embodiments, the operation for restoring the wagering game machine to a playable state includes operations comprising determining one or more modified files on the wagering game machine that were modified by the unsuccessfully executed tasks that cause the wagering game machine to be in the non-playable state; and replacing the one or more modified files on the wagering game machine with previous versions of the one or more modified files from the one or more configuration backup files.

In some embodiments, the operations further comprises presenting a notification message of the one or more problems via a user interface for an automated wagering game configuration system; and updating a database storing the one or more stored automated configuration tasks with status information concerning unexecuted tasks.

In some embodiments, a system comprises an automated configuration server comprising a task generator configured to generate one or more configuration tasks used to configure a wagering game machine, an interface controller configured to present information for the one or more configuration tasks via a user interface, a task store configured to store persisted task information, and a task controller configured to read the one or more configuration tasks from the task store, and execute the one or more configuration tasks based on casino events; and a wagering game machine comprises a configuration task processor configured to receive and process the one or more configuration tasks provided by the automated configuration server.

In some embodiments, the automated configuration server further comprises a configuration store configured to store one or more backup configuration files that provide a playable operational state on the wagering game machine, and a recovery unit configured to use the one or more backup configuration files to recover the wagering game machine to the playable operational state when the configuration task processor fails to successfully process the one or more configuration tasks.

In some embodiments, the system further comprises a systems coordinator configured to determine additional wagering game content from one or more of applications, services, hardware configurations, bonus game activity, progressive game activity, and tournament game activity, and convey the additional wagering game content to the task generator, wherein the task generator is further configured to dynamically generate the one or more configuration tasks based on the additional wagering game content.

In some embodiments, the system further comprises one or more of a primary wagering game server, a secondary wagering game server, a progressive server, a tournament server, a bonus server, a licensing server, a compatibility server, and an account server, configured to provide one or more casino related events, and wherein the task generator if configured to receive the events and use them to generate the one or more configuration tasks.

In some embodiments, a wagering game machine comprises an automated configuration module configured to receive one or more automated configuration tasks from a database, download one or more of wagering game files and configuration setting files from a gaming network device, based on the one or more automated configuration tasks, and install the one or more of the wagering game files and the configuration setting files by overwriting one or more existing files on the wagering game machine; and a configuration task processor configured to determine that the one or more of the wagering game files and configuration setting files did not install successfully; and replace the one or more of the wagering game files and configuration setting files with backup files.

In some embodiments, the configuration task processor is further configured to determine that the wagering game machine has been idle for a specified period according to a wagering game regulation; and re-install the one or more of the wagering game files and configuration setting files after the specified period.

In some embodiments, the configuration task processor is further configured to determine that the wagering game machine is performing an activity that conflicts with the installation of the one or more of the wagering game files and configuration setting files; delay the installation of the one or more of the wagering game files and configuration setting files until the activity is completed; and provide status information regarding the installation delay.

In some embodiments, an apparatus comprises means for determining a task batch of configuration tasks, wherein the task batch is stored in a non-volatile memory storage unit; means for determining that there are one or more wagering game activities occurring on a wagering game network that would affect the execution of the task batch; and means for modifying the task batch so that the task batch comports with the one or more wagering game activities.

In some embodiments, the task batch includes recurring properties set to periodically execute at a scheduled time to configure a wagering game machine, and wherein the means for modifying the task batch comprises means for modifying the recurring properties to execute at a different time.

In some embodiments, the one or more wagering game activities comprise a wagering game tournament and wherein the apparatus further comprises means to prevent the task batch from executing while the player is using the wagering game machine in the wagering game tournament.

In some embodiments, the one or more wagering game activities comprise a request from a wagering game server to provide secondary wagering game content, and wherein the means for modifying the task batch comprises means for incorporating the secondary wagering game content into the task batch.

In some embodiments, the one or more wagering game activities comprise a reinitialization procedure on a wagering game machine, and wherein the means for modifying the task batch comprises means for reporting the reinitialization as a suspended state and means for delaying execution of the task batch until the reinitialization procedure is complete.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

The inventive subject matter provides solutions to many challenges casinos face with maintaining and configuring gaming network devices. For example, FIG. 1 shows how a wagering game system can employ automated and persisted configuration tasks to configure wagering game machines on a gaming network.

Figure 1:
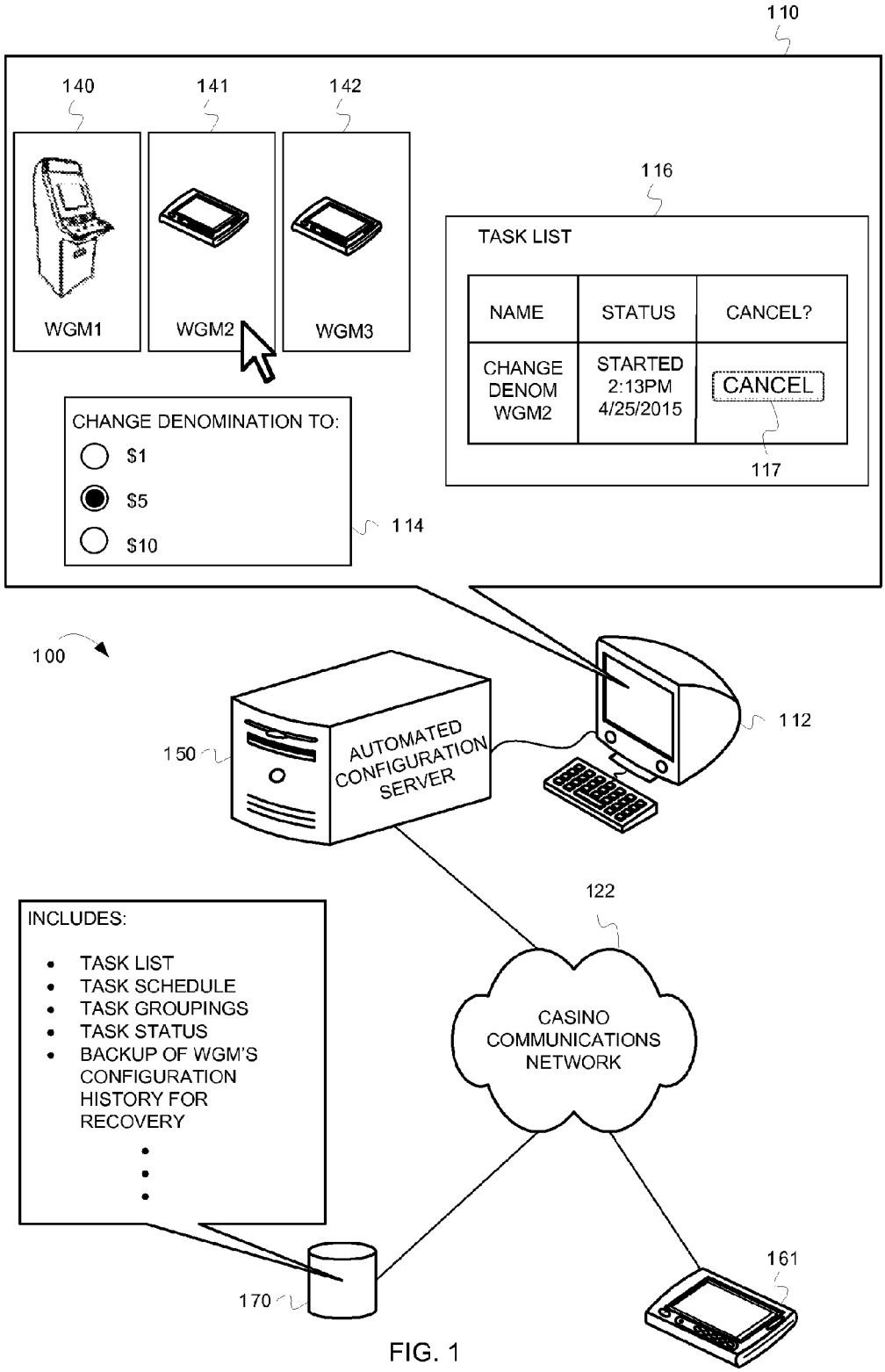
FIG. 1 is an illustration of automated configuration of a wagering game machine, according to some embodiments.

FIG. 1 is a conceptual diagram that illustrates an example of automated configuration of a wagering game machine, according to some embodiments. In FIG. 1, a wagering game system ("system") 100 includes an automated configuration server 150 connected to a wagering game machine 161 via a casino communications network 122. Also connected to the communications network is a persistent storage device (e.g., the database 170, a flat file system, a hard disk, or some other long-term, non-volatile memory, data store). In some embodiments, the database 170 can reside on the automated configuration server 150, on one or more wagering game machines, on a separate device, or on a combination thereof. The automated configuration server 150 can receive input, via a user interface 110. A terminal 112 can be connected to the automated configuration server 150. The terminal 112 can display the user interface 110 and control activities through the user interface 110. The user interface 110 can present various features, according to some embodiments, including a representation of devices on the casino communications network 122 such as wagering game machine graphics (graphics 140, 141, 142) representing individual wagering game machines. For example, graphic 141 may represent the wagering game machine 161. The system 100 tracks the location and operational state of the wagering game machine 161. A user can utilize the user interface 110 to control configuration of the wagering game machine 161. For example, a user can select the graphic 141 (e.g., via a mouse click). The user interface 110 can then present one or more options to configure the wagering game machine 161. One of those options may include a configuration panel 114 that can be used to change a feature of the wagering game machine, such as a denomination value (e.g., change the default wager value for the wagering game machine 161 to a higher or lower value). A user can select a specific denomination value via the user interface 110. In response, the automated configuration server 150 can generate a configuration task including instructions that the wagering game machine 161 can use to change its default denomination value. The automated configuration server 150 can also generate one or more characteristics, or properties, for the task (e.g., task properties), such as a task description, a task type, a task schedule, a task status, a task creation date or time, a task creation purpose, etc. The automated configuration server 150 stores the task and its properties in the database 170, or some other form of persistent store. The automated configuration server 150 can reference the database 170 to recall, re-execute, re-schedule, re-order, reclassify, or in some other way use and/or modify the configuration tasks. The automated configuration server 150 can generate a graphical representation of the configuration tasks in a task list 116. The task list 116 can include the task description and any other of its properties. The task list 116 can also include controls (e.g., buttons, drop-downs, sub-lists, etc.) that can control the behavior of the tasks. For instance, a cancellation control 117 can cancel the task from being executed or terminate the task during execution. Other controls can be used to (1) present metadata about the tasks (e.g., events that prompted the creation of the task, events that may affect the task, properties not displayed on the task list, etc.), (2) undo tasks, (3) redo tasks, (4) schedule tasks, etc. In some embodiments, the automated configuration server 150 can determine whether some controls are available according to operational rules. For example, the automated configuration server 150 can determine that a task is no longer cancelable when it has reached a certain point of execution. To do so might affect the performance of the wagering game machine or generate errors. As a result, the automated configuration server 150 can remove the control ability from the user interface 110. In some embodiments, as described in further detail below, the system 100 can determine when tasks have been unsuccessfully executed, and restore a wagering game machine to a previous configuration state, thus reducing down time for the wagering game machine. In other embodiments, the system 100 can determine conflicting activities on the casino communications network 122 and, based on the conflicting activities, prevent tasks from being performed, postpone tasks, reschedule tasks, undo tasks, etc.

Consequently, the system 100 can provide automated configuration, recovery, and other features that can be used to maintain various devices and processes on a gaming network. Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
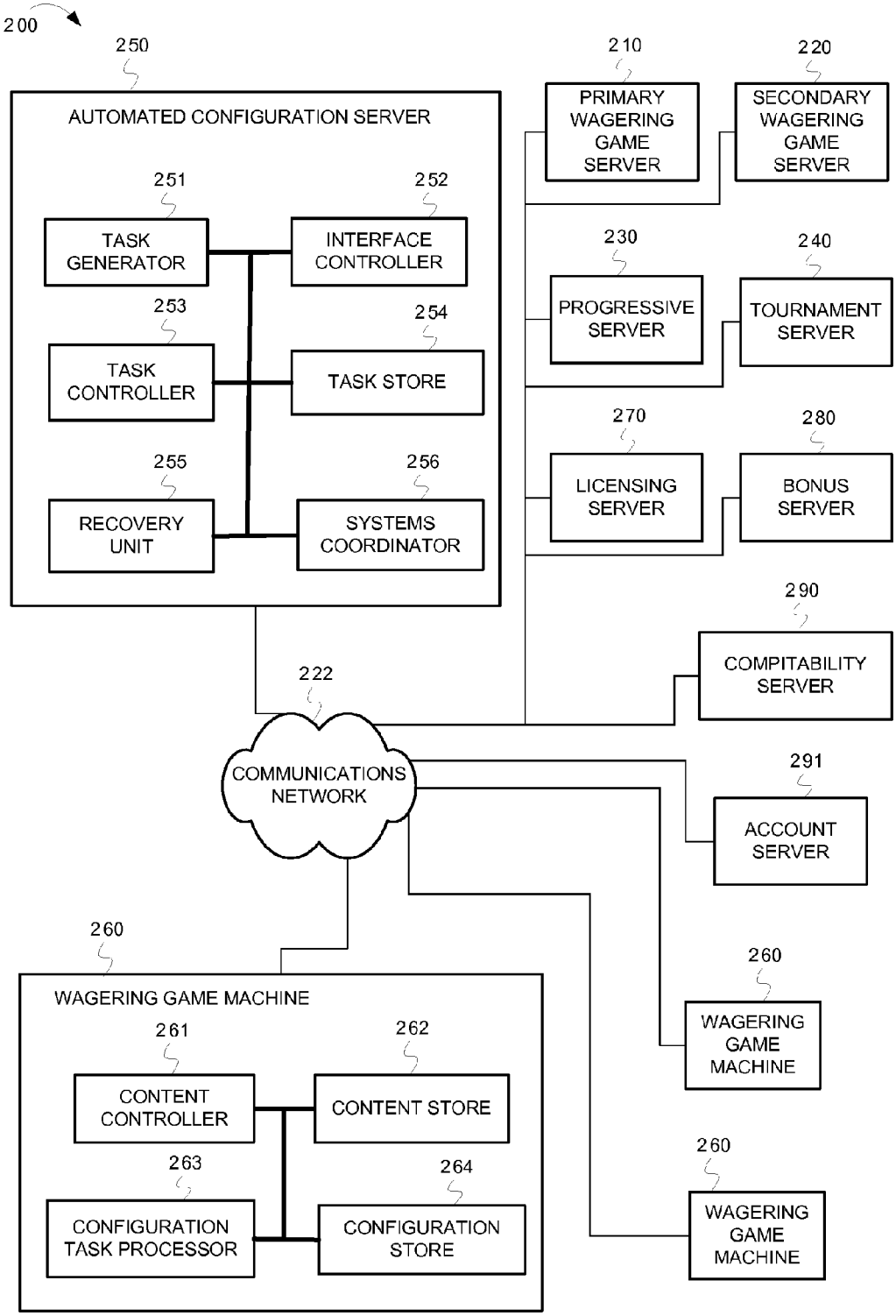
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an automated configuration server 250 configured to control the creation and execution of configuration tasks. The automated configuration server 250 can include a task generator 251 configured to generate, schedule, and group configuration tasks. The automated configuration server 250 can also include an interface controller 252 configured to present task controls and information via a user interface. The automated configuration server 250 can also include a task controller 253 configured to execute tasks, monitor system events, monitor existing casino applications and/or configurations, and work with the task generator 251 to modify tasks. The automated configuration server 250 can also include a task store 254 configured to store task information and task lists. The task store 254 can be a persistent storage unit for storing the tasks beyond power cycles or other activities that may annihilate task instructions. The automated configuration server 250 can also include a recovery unit 255 configured to recover wagering game machines to an operational state when task execution is unsuccessful. The automated configuration server 250 can also include a systems coordinator 256 configured to analyze applications, services, hardware configurations, etc. on a gaming network to assist the task generator 251 in creating tasks. The system coordinator 256 can convey casino events to the task generator 251 to dynamically generate configuration tasks.

The wagering game system architecture 200 can also include one or more wagering game machines 260 connected to the automated configuration server via a communications network 222. The wagering game machines 260 can include a content controller 261 configured to manage and control content and presentation of content on the wagering game machines 260. The wagering game machines 260 can also include a content store 262 configured to contain content to present on the wagering game machines 260. The wagering game machines 260 can also include a configuration task processor 263 configured to receive and process one or more configuration tasks provided by the automated configuration server 250. The wagering game machines 260 can also include a configuration store 264 configured to store past configurations so that the wagering game machine can be restored to a previous configuration state when configuration tasks are unsuccessfully executed.

The wagering game system architecture 200 can also include other devices that provide a variety of wagering game activities and events. Those other devices can include a primary wagering game server 210, a secondary wagering game server 220, a progressive server 230, a tournament server 240, a licensing server 270, a bonus server 280, a compatibility server 290, and an account server 291. The primary wagering game server ("primary host") 210 is configured to provide primary wagering game content and control information to the wagering game machines 260. The secondary wagering game server ("secondary host") 220 is configured to provide secondary wagering game content and control information to the wagering game machines 260. The primary host 210 can provide wagering game content from a first wagering game manufacturer. The secondary host 220 can provide wagering game content from a second wagering game manufacturer. Secondary wagering game content can be content that is requested by a wagering game player in addition to primary wagering game content that was already presented or requested (e.g., to play concurrently with primary wagering game content). The secondary host 220 can provide the requested type of secondary content. The secondary host 220 can also provide primary wagering game content if requested by the primary host 210. Other examples of secondary content include content that is provided unexpectedly during the use of primary wagering game content. Examples of unexpected secondary wagering game content includes bonus games and progressive game that appear as a result of something that occurred as a result of using the primary wagering game content. The progressive server 230 and the bonus server 280 can provide the unexpected type of secondary wagering game content. The automated configuration server 250 can receive primary and secondary wagering game content and incorporate that content into the generation and execution of configuration tasks. For example, the automated configuration server 250 may generate a task to provide primary wagering game content. However, the progressive server 230 or the bonus server 280 may suggest some additional content to provide unexpectedly along with the primary wagering game content. As a result, the automated configuration server 250 may modify or add tasks that incorporate the secondary wagering game content with the primary wagering game content.

Some devices may assist wagering games (e.g., provide wagering game tracking or configuration abilities, provide assistance with the function of wagering games, etc.), such as the tournament server 240, the licensing server 270, the compatibility server 290, and the account server 291. The tournament server 240 is configured to track activities that occur within primary and or secondary wagering game content as part of a tournament competition between players. The tournament server 240 may also be considered a provider of primary and/or secondary wagering game content since it reports information about wagering game content and/or can provide tournament related themes and assets. The licensing server 270 can be configured to provide licenses and licensing control for wagering game content. The compatibility server 290 can be configured to determine compatibility between business rules, hardware, software, and configurations of all devices on a wagering game network. The account server 291 can be configured to control user related accounts accessible via wagering game networks and social networks. The account server 270 can also store and track player information, such as identifying information (e.g., avatars, screen name, account identification numbers, etc.) or other information like financial account information, social contact information, etc. The account server 270 can also contain accounts for social contacts referenced by the player account. The account server 270 can also provide auditing capabilities, according to regulatory rules, and track the performance of players, machines, and servers. The automated configuration server 250 can also incorporate information provided by these devices into configuration tasks.

Each component shown in the wagering game system architecture 200 is shown as a separate and distinct element. However, some functions performed by one component could be performed by other components. For example, services provided by the wagering game servers 210, 220, the progressive server 230, the tournament server 240, the licensing server 270, the bonus server 280, the compatibility server 290, and the account server 291 may be combined into each other and/or into the automated configuration server 250. In another example, although the wagering game machines 260 can store configuration data in the configuration store 264, the automated configuration server 250 can also make backup copies of configurations data on wagering game machines 260 and store the configuration data in the task store 254. Furthermore, the components shown may all be contained in one device, but some, or all, may be included in, or performed by multiple devices, as in the configurations shown in FIG. 2 or other configurations not shown. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
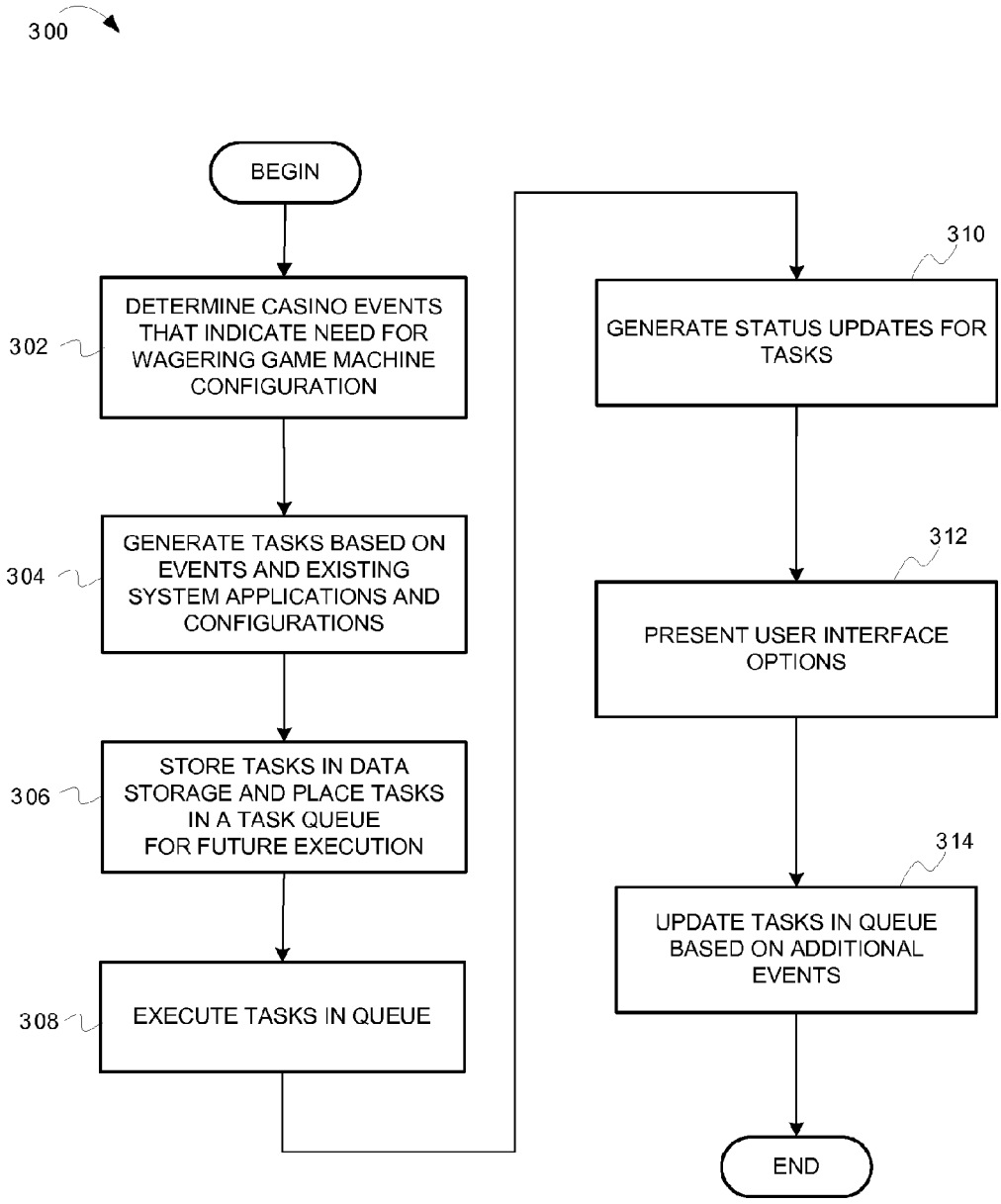
FIG. 3 is a flow diagram 300 illustrating generating and controlling configuration tasks, according to some embodiments.

FIG. 3 is a flow diagram illustrating generating and controlling configuration tasks, according to some embodiments. In FIG. 3, the flow 300 begins at processing block 302, where a wagering game system ("system") determines casino events that indicate a need for one or more wagering game machine configurations. The system can detect events that occur on a gaming network. Some of those events can be user generated, such as via selecting configuration options in a configurations interface (e.g., see user interface 110 in FIG. 1). Some of the events can be system generated, or rather, generated by devices and/or processes without user interaction. The events can result from existing applications, services and/or machine configurations that operate on the wagering game machines. Some of those existing applications include schedulers, agents, and other controllers that provide information about how the applications, services and machine configurations are operating to maintain wagering games. FIG. 2 illustrates some examples of existing devices on a gaming network that can provide events, such as wagering game servers, progressive controllers, tournament controllers, etc. The events indicate a need to modify a configuration on one or more of the devices on the gaming network, including wagering game machines. The system can respond to the user or system generated events by generating one or more persisted instructions or tasks.

The flow 300 continues at processing block 304, where the system generates one or more configuration task(s) ("tasks") based on the events and existing system applications and configurations. The system uses the determined events to generate the tasks. Tasks can contain instructions targeting specific wagering game machines as well as tasks that contain instructions for the system itself (e.g., for servers and other devices). The tasks represent functional units of work that the system can execute individually or in groups (e.g., batches). The system can generate and assign properties for the tasks that identify, characterize and classify the tasks. For example, the system can classify tasks into groups based on the origin of the events, such as "user" generated tasks versus "system" generated tasks. The system can place the tasks in a viewable list (e.g., see task list 116) so that the operator can view properties of the tasks and control the tasks (e.g., cancel tasks prior to execution, reorder tasks, reschedule tasks, change task priorities, etc.). The system can monitor system events and can dynamically generate tasks in response to the system events. For example, a wagering game theme product may have been partially installed on a wagering game machine at a time when an error was detected on the wagering game machine. The system can detect the installation error and create system tasks to remove the portion of the wagering game content that was installed up to that point as part of a recovery procedure (see FIGS. 4, 5 and 6 for additional examples of wagering game machine recovery). The system may remove the ability for an operator to control the creation or cancellation of some types of tasks (e.g., system tasks, critical tasks, etc.). The system, however, may still list those tasks in the task execution list of the user interface. In some embodiments, the system can group tasks together into a task batch. Each task batch can have a list of associated properties, such as a task batch identifier, the task batch target, a task batch execution time, description of operations in the task batch, and overall task batch status. The system can also present task batches in a task list for an operator to view. The system can also schedule a batch of tasks to be executed at some later point in time. The system's user interface can provide controls that specify a date and time for a configuration to take place. The system can schedule recurring tasks, or tasks that occur periodically according to a scheduled set of instructions. Further, the system can generate tasks based on secondary, or additional, wagering game information. For example, a wagering game machine may require an installation of primary wagering game content from a primary host, which the system can generate tasks to perform. However, a bonus server may have some additional wagering game content to install on top of the primary wagering game content to add to the wagering game experience, such as a "mystery", or unexpected bonus game. Though the system event may not have requested the additional wagering game content, the system can listen to network devices, such as the bonus server (or others servers like a progressive server, a tournament play server, a licensing server, etc.), and generate additional tasks that will install the additional wagering game content. In another example, a primary host may generate an event that the system detects and attempts to generate configuration tasks from. However, before generating the tasks, the system may first consult with a secondary host and generate the tasks so that they may allow, or exclude, operational compatibility with the secondary host.

The flow 300 continues at processing block 306, where the system stores the tasks in data storage and places the tasks in a task queue, or list, for future execution. The system can list the tasks on an ordered task queue or list. The system can order and group the tasks on the task list according to various properties, such as by start time, by priority, by task type, etc. The system can store the tasks in a persistent storage device or data store, such as non-volatile memory, a file system, a hard disk, a relational database, etc. The tasks are persisted in the data store and can be selected and acted upon by the system or any of its automated configuration services, controllers, and/or agents. In some embodiments, the system stores all of the tasks in two programming formats within the persistent storage device, (1) a form that is human readable, and (2) a binary format. The binary format allows the system to quickly and efficiently access, execute, and modify tasks. At the same time, the system can present the same tasks in human readable format within a user interface, in reports, in messages, etc.

The flow 300 continues at processing block 308, where the system executes the tasks in the task queue. The system executes the tasks by their order in the task queue. The system can utilize a service that executes the tasks, and to which the a device (e.g., wagering game machines) on the gaming network can subscribe. The system can execute the tasks in groups or batches. The system can monitor all task batches and run batches through the queue. The system executes the batches as they meet their scheduled date and time specified in the queue. The system determines the target device for which the task batch is designated and sends the instructions through the gaming network until reaching the target device. The target device can process the instructions for the tasks and report back, via the gaming network, any status updates, errors, successes, or other events. The system can also execute tasks according to a recurring schedule, such as tasks that occur at a certain time every day, a certain day of the week, etc. The system can also execute tasks on periodic intervals (e.g., every x hours). The system can also intelligently reschedule already scheduled tasks that are about to be executed based on events that are occurring on the network, or that have occurred in the meantime between creation and execution. The system tracks and stores all events that may affect recurring tasks according to scheduling rules. The system can store a history of those events in the data store and use the event history to generate and modify tasks. For instance, the system can store the tasks in one table of a database and event history in another table of the database, with a relational table that correlates certain types of events with specific types of tasks. The system can refer to the events that occurred, or are occurring, since the last time the recurring task ran to determine if there are any conflicts or indications that the tasks should be postponed, modified, cancelled, etc. The system can dynamically modify tasks based on the event history. The system can also execute tasks across wagering game machines. For example, the system can schedule a specific batch task to execute, such as a volume change, for a bank of wagering game machines at the same time. The system can also prioritize tasks and execute the tasks according to their priorities. For instance, if the system has scheduled a task that changes a denomination value for a single wagering game machine and also has a task to make a volume change for the wagering game machine (as part of a batch task applied to a bank of machines), the system may prioritize the tasks and execute the volume change first and then the denomination change second. The system can also assign security properties to tasks so that only certain user accounts, services, or devices can initiate or execute tasks.

The flow 300 continues at processing block 310, where the system generates status updates for the tasks. The system determines a status for the tasks (e.g., monitors time to complete tasks, determines what tasks have been completed and what still needs to be done, etc.). Every task (and batch) can have a status associated with it. When the state of a task changes, the system updates the status of the task in the data store and makes the status update viewable via a user interface for a target device (e.g., the targeted wagering game machine). The system can provide various indicators in the user interface for status changes (e.g., color-code tasks according to type, status severity, time, etc.) as well as verbal descriptions of the status information. Some status indicators and descriptions may be used only by particular types of tasks. The system can recognize the status types and use them to properly time and execute the tasks. For example, the system may generate a specific type of task that detects a device connected to a wagering game device (a "device detection" task). During a device detection tasks, the system installs a file on the wagering game machine that will detect a peripheral device but only after the wagering game machine performs an operation (e.g., a reboot or re-initialization), that can momentarily drop communication with the system then reconnect to report any new devices. While the wagering game machine is out of communication, the system can indicate the tasks execution status as being "suspended". The system can generate the device detection tasks anticipating the suspended state. When the suspended state occurs, the system can recognize the "suspended" status indicator and, instead of treating the suspended state as an error, suspend execution until the wagering game machine resumes communication.

The flow 300 continues at processing block 312, where the system presents user interface options. As mentioned previously, some of the options can include columns, pop-ups, panels, or other indicators, of properties of the tasks. Some options can include controls, like cancellation controls to cancel tasks. In some embodiments, the system can restrict cancellation based on whether it would affect a wagering game machine's performance. For instance, a task batch may include multiple tasks that are being executed. Some of those tasks may have already been executed while other remaining tasks are waiting to be executed. However, if cancelling the remaining tasks would cause the target wagering game machine to become inactive or go offline, then the system can prevent the remaining tasks from being cancelled. The system could therefore deactivate the cancellation control available in the user interface.

The flow 300 continues at processing block 314, where the system updates the tasks in the task queue based on additional events. Events may occur on the gaming network after the tasks were generated, executed, etc. As a result, the system can analyze the additional events and adjust the tasks. The system can continuously compare stored tasks with ongoing events to determine potential and real conflicts with existing tasks. The system can notify system administrators, via the user interface, of the conflicts.

Figure 4:
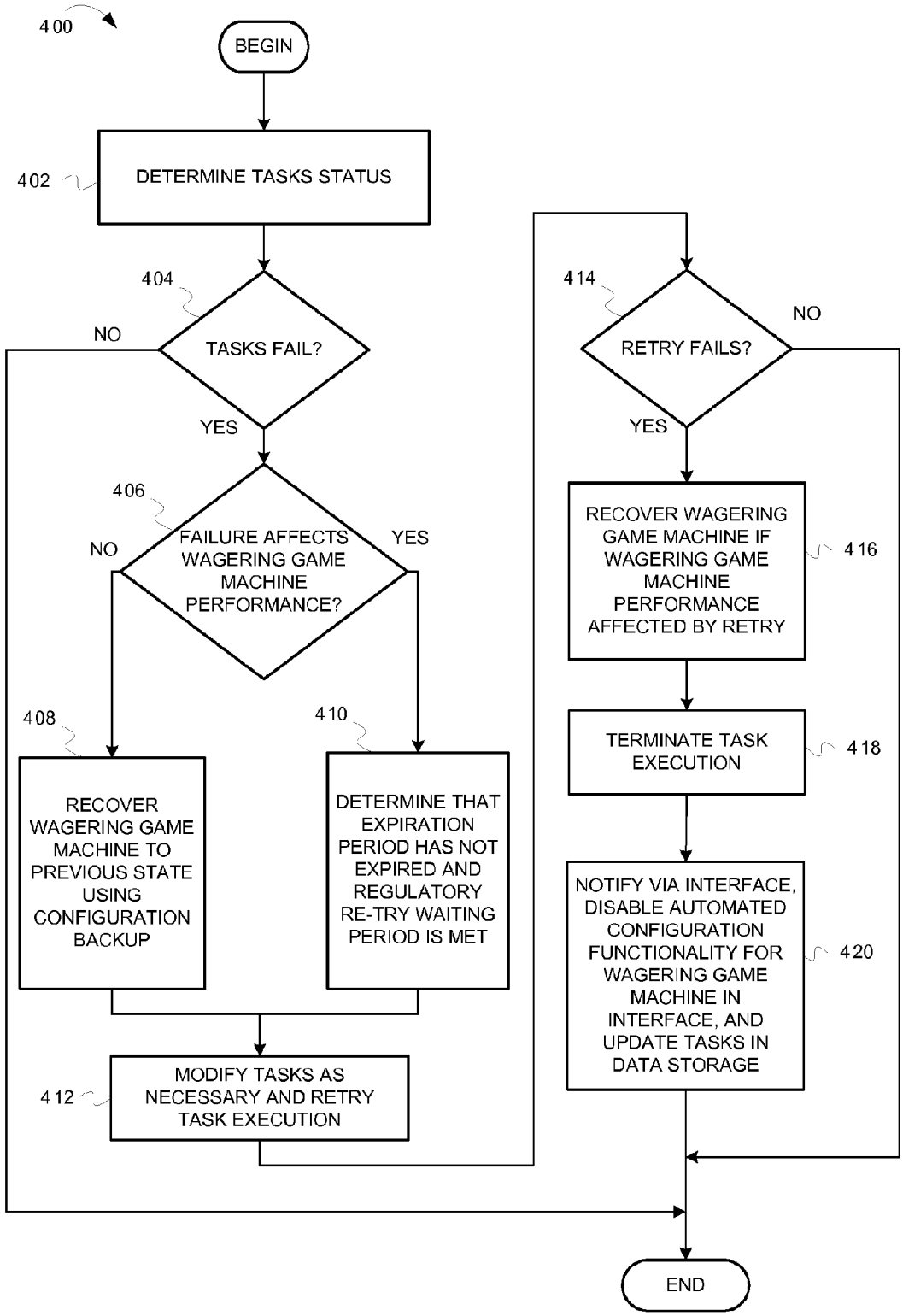
FIG. 4 is a flow diagram 400 illustrating controlling unsuccessful attempts to execute configuration tasks, according to some embodiments.

FIG. 4 is a flow diagram illustrating controlling unsuccessful attempts to execute configuration tasks, according to some embodiments. In FIG. 4, the flow 400 begins at processing block 402, where a wagering game system ("system") determines the status of the tasks. The system can detect the status of a task by requesting status information from a wagering game machine that processes the tasks. The wagering game machine can reply with event data regarding the task processing.

The flow 400 continues at processing block 404, where the system determines whether any of the tasks failed to successfully execute. The system receives the status information from the wagering game machine and determines, from the status information, whether the tasks executed. If the tasks did successfully execute, then the system can report the successful operation, update the task list in the user interface, and update the data store. The process can then end. If the tasks did not successfully execute, then the process continues at block 406.

The flow 400 continues at processing block 406, where the system determines whether the reason for the failure was a problem that affects the performance of the wagering game machine. Reasons for failure may be caused by various conditions and activities on a gaming network (e.g., network connectivity problems, routing errors, application/configuration conflicts, scheduling problems, hardware malfunctions, version control issues, packet expiration, etc.). Some of these problems may not affect the performance, or state, of the wagering game machine. In other words, the wagering game machine may remain in a state capable of playing at least some wagering games. Some regulatory requirements for gaming may impose regulatory rules regarding the amount of time that a wagering game machine needs to be operational. Further, many casinos do not want wagering game machines out of operation because casino patrons will not be able to play wagering games. The inability of a single wagering game machine to generate revenue can impact a casino's profits because those wagering games are restricted to play within the casino. If the wagering game machine is offline, then the casino loses the ability to generate revenue from that wagering game machine until it is serviced and brought back online Further, specific wagering game manufacturers lose profits and game market share when their wagering game machines are offline. Some wagering games from a wagering game provider may only be available on the manufacturer's wagering game machines specifically manufactured for those games. Therefore, if a task performance failure affects the ability for the wagering game machine to offer casino patrons the ability to play wagering games, then the system detects and reacts accordingly. If a wagering game machine's performance is affected (e.g., becomes non-operational, or non-playable) as a result of the task failure, then the process continues at block 408. If not, then the process continues at block 410.

The flow 400 continues at processing block 408, where the system recovers the wagering game machine to a previous state using a configuration backup. As stated previously, the wagering game machines operational state is very important to maintain. The system, therefore, can automatically restore the wagering game machine to a previous configuration state when there are problems that affect the operational status of the wagering game machine. The system can access a backup of one of the wagering game machine's previous, stable, configurations (e.g., files, settings, etc.). The configuration backup can be stored on the wagering game machine, on the task data store, or on other gaming network storage devices. The system may need to undo some tasks that were un-done, overwrite new files with old files, and/or perform any other operation necessary to remove unsuccessfully installed configuration files and applications, then rewrite or replace them with files from the backup configuration files.

The flow 400 continues at processing block 410, where the system determines that the tasks expiration periods have not expired and that regulatory re-try waiting periods are met. The system may lose communication with the wagering game machine when a problem arises while a task is in progress. The communication loss problem may not require a recovery because the wagering game machine may still be operational. In many cases, system and wagering game machine quickly re-establish communication and continue with the task execution until completion. However, there may be extended periods when communication remains offline. When this happens the system can monitor the length of time a task has been pending. If the amount of time that the task has been pending exceeds an allowable time for the task execution, then the task (and batch) can change their task status to a "timeout" state and give up on the configuration. For a "suspended" task status (see FIG. 3 above for more explanation on "suspended" status), the system can delay the period that counts toward a timeout, or can add extra time to the expiration period if the system anticipates a suspended state. If, however, the status for the task has not timed-out, then the system may retry the task operation. Many wagering game regulations, however, require a wagering game machine to be in an idle state for certain amounts of time prior to making any configuration changes. Some regulations may also require the wagering game machine to have zero credits, not be in an administrative screen, and not be in a tilt state for that period of time to be deemed idle. As a result, even though the wagering game machine may not be affected by the communication loss problem, the system may need to wait until all of the jurisdictional requirements have been met before trying to execute the tasks again.

The flow 400 continues at processing block 412, where the system modifies tasks as necessary and retries task execution. The system can modify the tasks by adding new tasks, cancelling tasks, reordering tasks, rescheduling tasks, etc., based on what tasks were executed, what events have occurred since the tasks were generated, or any other factor that may affect the subsequent re-execution attempt. The system can generate and execute a recovery task batch ("recovery batch"), which may be different from the original task batch as it includes operations that restore the wagering game machine. The system can generate the recovery batch by determining how many tasks of the original task batch were successfully completed, and the nature of what happened to the wagering game machine when completed. Based on that information, the system determines what tasks need to be undone and redone. In some embodiments, the system may modify the backup configuration files so that only some of the backup files are applied. For instance, if a task was successfully executed, but the wagering game machine can still function properly with the configuration change made by the new task, then the system can generate the recovery batch without undoing the successfully executed task. The system can modify the backup configuration files so that it does not overwrite the configuration change made by the successful task execution. In some embodiments, this may include using multiple backup recovery files that are segmented for different portions of the wagering game machine so that the system can use only some of the multiple backups during the recovery process. In other embodiments, however, the system may remove all configurations made by tasks, whether or not some were successful, to avoid having to perform compatibility checks to determine if configuration changes generated by the successful execution tasks would be compatible with older configuration files and settings. In some embodiments, the system can generate the recovery batch when it detects a status update indicating a need for recovery. In other embodiments, the system can generate the recovery batch at the same time that it creates the original task batch and store the recovery batch in the data store if needed. To apply the recovery batch, the system executes tasks within the recovery batch that will (using some or all of the configuration backup information) remove and/or rewrite of the some or all of the configuration changes (e.g., software installs, setting changes, etc.) on the wagering game machine to return the wagering game machine to an operational, playable state. In some embodiments, the system may have to generate and execute more than one recovery batch, modifying each subsequent recovery batch based on the successes and failures of the previous recovery batch, until the machine is successfully recovered. The system may also need to generate recovery tasks for other devices associated with the wagering game machine and/or the original task batch. For example, if the system acquires a license for a wagering game content download, from a license server, and sends the wagering game content download to a wagering game machine, but the wagering game machine reports a download failure, then the system can generate a system batch to release the license seat and update the license count on the licensing server. Recovery batches can take precedence over scheduled tasks batches to ensure that the wagering game machine has maximum up time. Once the wagering game machine is recovered, the system can then (a) retry the original task batch or (b) give an operator a chance to review what went wrong, but still allow the wagering game machine to be operational. The system can retry or re-attempt the configuration at a pre-determined frequency for a pre-determined amount of time that can be configurable by an operator. For example, some gaming regulations may require a specified pre-configuration idle period (e.g., 4 minutes). The system can thus default the retry frequency to a period beyond the pre-configuration idle period (e.g., 5 minutes) with a retry span (e.g., retries every five minutes for a 60 minute period). If, after 60 minutes (or whatever the span is modified to) the wagering game machine is still unable to go to an idle state then the task batch may fail. Increasing the frequency and span of the retry may increase the likelihood of success, but may also prevent other configurations from starting for that wagering game machine until the retry has completed or been exhausted. In some embodiments, the system can detect when a task was already completed. Sometimes environments and activities (e.g., asynchronous threading and state changes) may cause a task to be executed twice. The system, however, can detect when a task had already been completed by analyzing the configurations on a wagering game machine, by receiving errors that indicate that a configuration had already been performed (e.g., a wagering game machine indicates that a file has already been installed), etc. Therefore, in some instances, although a retry may return an error, the system can treat the error message as a successful completion, not a failure, if the error message indicates that the configuration had previously been made.

The flow 400 continues at processing block 414, where the system determines whether the retry fails. If the retry did successfully execute, then the system can report the successful operation, update the task list in the user interface, and update the data store. The process can then end. If not, then the process continues at block 416.

The flow 400 continues at processing block 416, where the system recovers the wagering game machine if its performance was affected by the retry. During the retry, the performance of the wagering game machine may be affected. If so, then the system can perform the same operations described at block 408 to recover the wagering game machine.

The flow 400 continues at processing block 418, where the system terminates the tasks execution. In addition to recovering the wagering game machine, if necessary, the system may repeat the retry (see block 414) and/or decide to terminate the task batch to allow an operator to take manual intervention.

The flow 400 continues at processing block 420, where the system notifies the automated configuration server via the user interface about the task termination, disables one or more automated configuration functionality for the wagering game machine via the user interface, and updates the task entries in the data store. The system can notify the operator of the termination by sending a termination message to an operator via the user interface. The operator can then perform manual maintenance (e.g., clear the random access memory (RAM) of the wagering game machine and determine the problems preventing the task batch from successfully executing). The system can also disable any functionality from the user interface for automatically configuring that wagering game machine until the problems are corrected and the wagering game machine is up and running properly.

Figure 5:
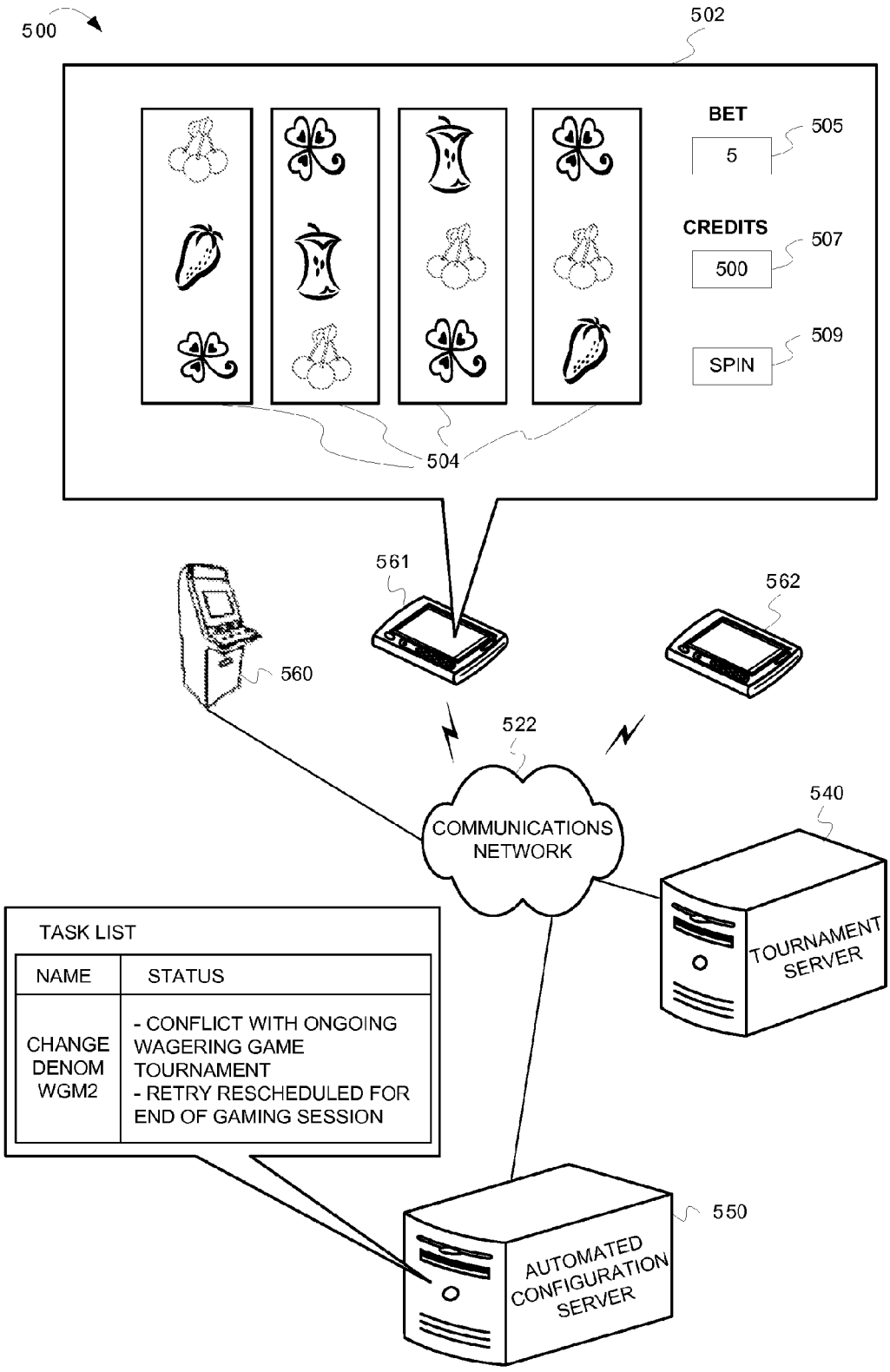
FIG. 5 is a flow diagram 500 illustrating processing configuration batch tasks by a wagering game machine, according to some embodiments.
Figure 6:
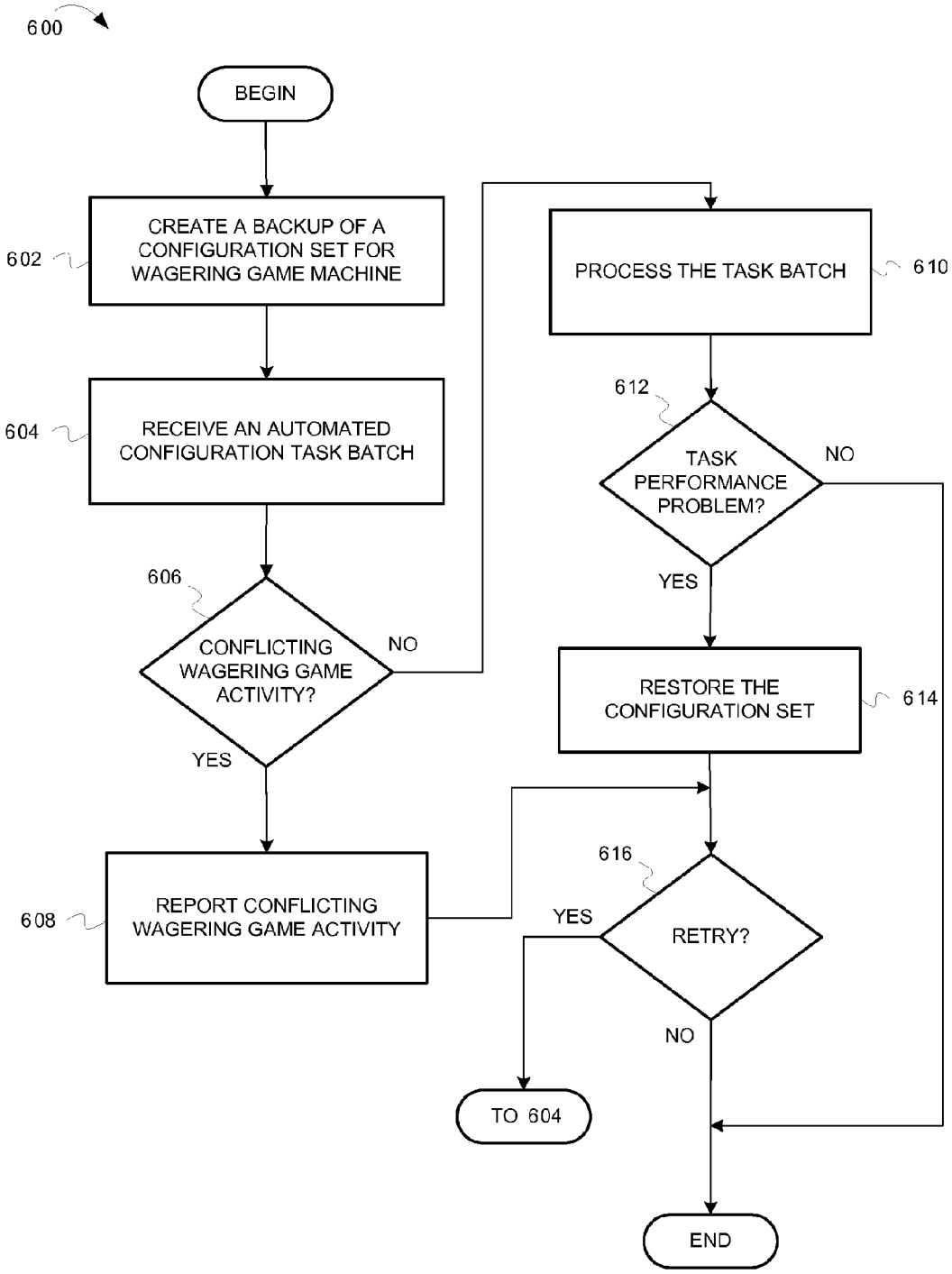
FIG. 6 is an illustration of processing configuration batch tasks with wagering game activity conflicts, according to some embodiments.

FIG. 5 is a flow diagram illustrating processing configuration batch tasks by a wagering game machine, according to some embodiments. In FIG. 5, the flow 500 begins at processing block 502, where a wagering game machine creates a backup of its configuration set. The wagering game machine can create the backup of the configuration set (e.g., the files, settings, and other information that permit the wagering game machine to function in an operational and playable state playable state). The wagering game machine can create the backup immediately before processing any configuration tasks so that the wagering game machine has a configuration set that is stable and reliable. Depending on the tasks to be performed, the system may backup more of less of the configuration information (e.g., potentially a full image backup of the wagering game machine's configuration files in the case of complex tasks, or only a few files for less complex tasks). In some embodiments, the wagering game machine can create backups after successful executions of some tasks. In other embodiments, the wagering game machine can make backups as part of an ongoing schedule so that the wagering game machine can always have a stable configuration set in backup and avoid having to wait to generate a current backup before performing every task execution. In some embodiments, the wagering game machine can generate separate backup configuration sets for different portions or elements of the wagering game machine's operational system.

The flow 500 continues at processing block 504, where the wagering game machine receives an automated configuration task batch. In some embodiments, the task batch may be a recurring task batch that was stored in a data store on the gaming network and that executes according to a recurring schedule. An automated configuration server can execute the recurring task batch for a specified time and date associated with the recurring task batch.

The flow 500 continues at processing block 506, where the wagering game machine determines whether there are any conflicting wagering game activities occurring on the wagering game machine, or on the network. Some wagering game activity may occur on the wagering game machine, or on the network, that may affect the performance of the wagering game machine and/or conflict with the current operation of the wagering game machine if the recurring task batch were to be executed. For instance, In FIG. 6, a wagering game system 600 includes several wagering game machines 660, 661, 662 connected to a tournament server 640 via a communications network 622. The wagering game machines 660, 661, 662 are engaged in a wagering game slot tournament. The wagering game machine 661 includes a display 602 showing slot reels 604, a spin control 609, a credit meter 607 and a bet meter 605. An automated configuration server 650 attempts to execute a recurring task (or task batch depending on the number of tasks needed) that changes the denomination value(s) of the wagering game machine 661 at a specified time and date. The recurring task, however, could very likely interfere with the slot tournament by changing the default value of the bet meter 605.

Returning momentarily back to FIG. 5, at processing block 508 the wagering game machine can recognize the conflict before processing task batch commands and report the conflict. The wagering game machine can resume normal operations and wait, at block 516, until the automated configuration server retries the task batch and/or sends an updated task batch to deal with the conflict. For example, in FIG. 6, the automated configuration server 650 receives the reported conflict and reschedules the task batch to execute only after the player's wagering game session has ended and the player has completed use of the wagering game machine 661.

Returning again to FIG. 5, if there are no conflicts at processing block 506, the flow 500 continues at processing block 510, where the wagering game machine processes the task batch. The wagering game machine can receive the task batch and processes all tasks according to an order indicated in the task batch. The wagering game machine can communicate with various casino devices (e.g., licensing servers, compatibility servers, wagering game servers, etc.) to obtain downloads, configuration settings or files, or other information from those devices when processing the tasks. In some embodiments, an intermediary device in the system can process the tasks and generate protocol specific instructions. The intermediary device may be configured to understand the tasks and translate them to the instructions. The intermediary device can then send the instructions to specific wagering game machines, or other devices, that need configuration on the system. The wagering game machines and/or other devices can receive the instructions and process the instructions.

The flow 500 continues at processing block 512, where the wagering game machine determines whether there are any performance problems resulting from task execution. The wagering game machine monitors its state for problems that may affect the performance of the wagering game machine (e.g., goes offline, loses game play abilities, experiences installation errors, etc.). If there are no problems, then the process ends. If there are problems, then the process continues at block 514.

The flow 500 continues at processing block 514, where the wagering game machine restores the configuration set. FIG. 4 above describes some detail regarding restoring or recovering a configuration set. The wagering game machine can then resume normal operations while waiting for an updated task batch, for a retry attempt, or for an indicator of a manual reconfigure procedure for the wagering game machine.

The flow 500 continues at processing block 516, where the wagering game machine determines whether the automated configuration task batch should be re-executed. For example, the automated configuration server may attempt to retry the task batch by sending an updated task batch (e.g., with a changed schedule, with additional or fewer tasks, etc.). In some embodiments, the task batch may be identical to the original task batch. If a retry attempt is initiated, then the process can return to block 504. Otherwise, the wagering game machine can resume its normal operation and the process ends.

Additional Example Operating Environments

This section describes example operating environments, systems and networks, and presents structural aspects of some embodiments.

Wagering Game Machine Architecture

Figure 7:
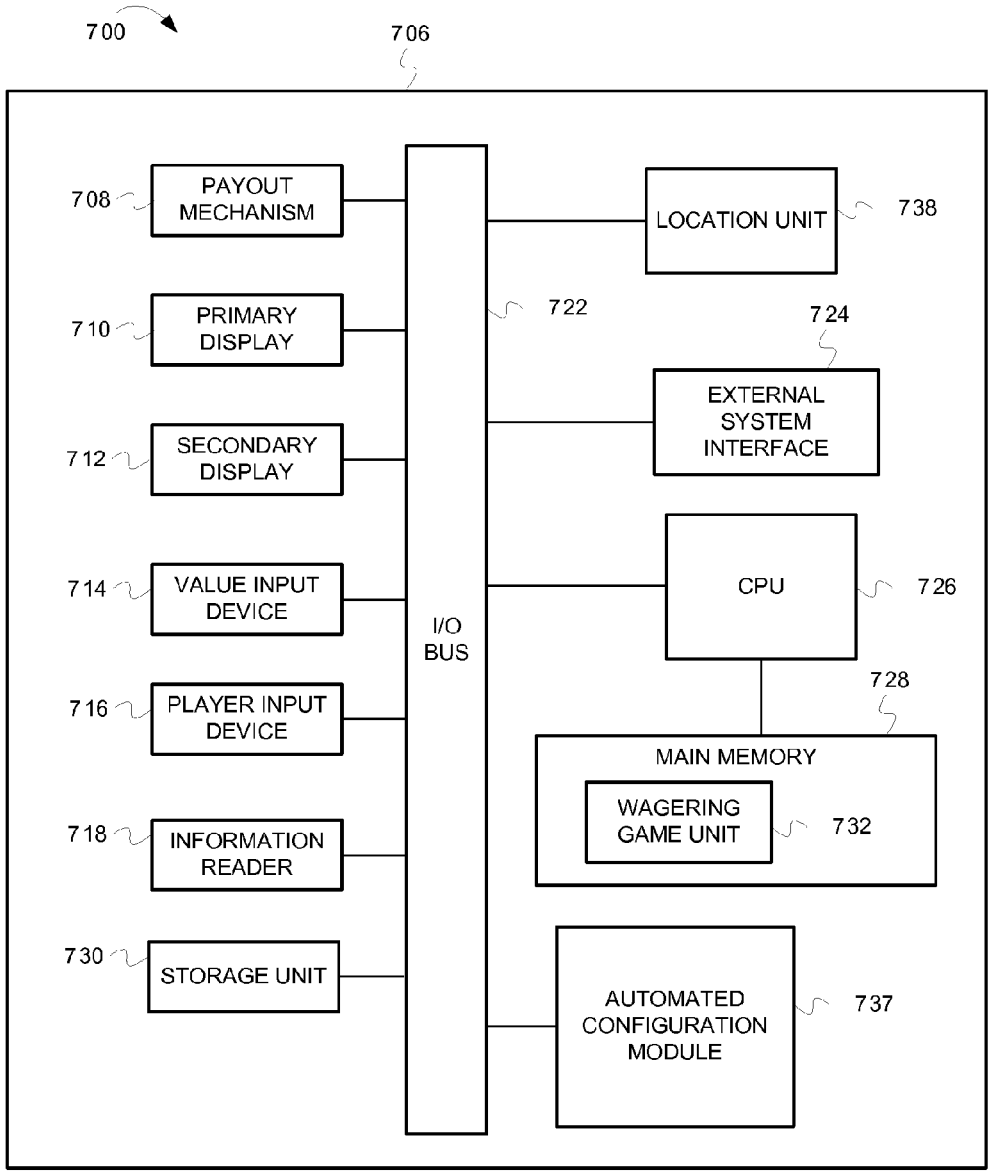
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes an automated configuration game module 737. The automated configuration module 737 can process communications, commands, or other information, where the processing can automatically configure and recover gaming network devices, including wagering game machines.

Furthermore, any component of the wagering game machine 706 can include hardware, firmware, and/or machine-readable media including instructions for performing the operations described herein.

Mobile Wagering Game Machine

Figure 8:
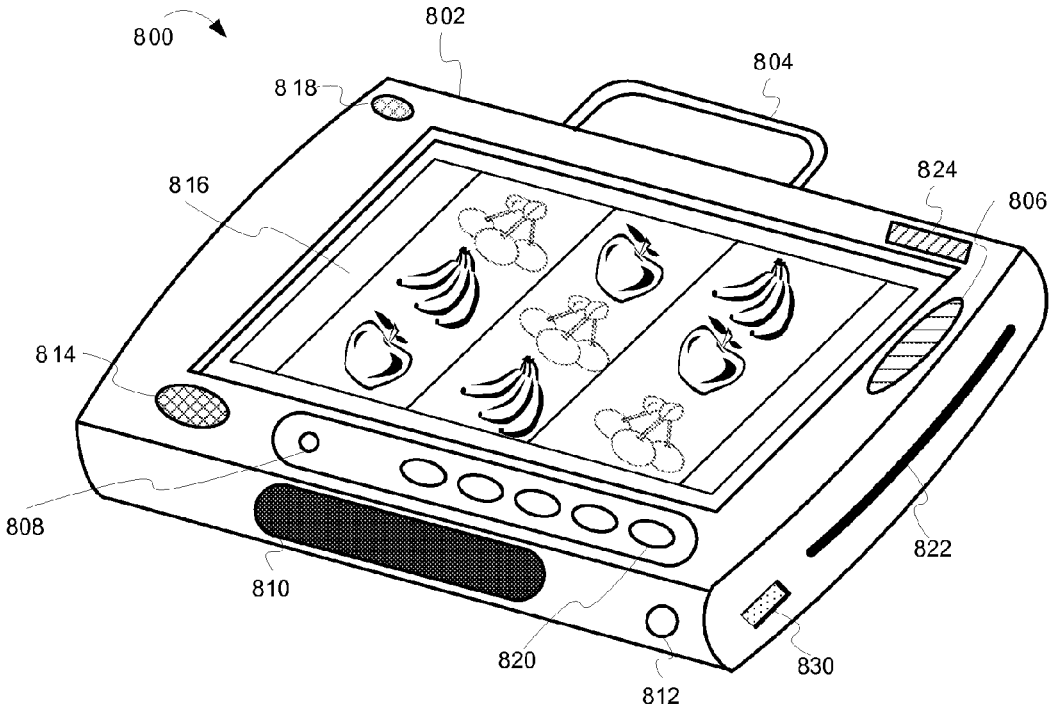
FIG. 8 is an illustration of a mobile wagering game machine 800, according to some embodiments.

FIG. 8 is a conceptual diagram that illustrates an example of a mobile wagering game machine 800, according to some embodiments. In FIG. 8, the mobile wagering game machine 800 includes a housing 802 for containing internal hardware and/or software such as that described above vis-à-vis FIG. 7. In some embodiments, the housing has a form factor similar to a tablet PC, while other embodiments have different form factors. For example, the mobile wagering game machine 800 can exhibit smaller form factors, similar to those associated with personal digital assistants. In some embodiments, a handle 804 is attached to the housing 802. Additionally, the housing can store a foldout stand 810, which can hold the mobile wagering game machine 800 upright or semi-upright on a table or other flat surface.

The mobile wagering game machine 800 includes several input/output devices. In particular, the mobile wagering game machine 800 includes buttons 820, audio jack 808, speaker 814, display 816, biometric device 806, wireless transmission devices 812 and 824, microphone 818, and card reader 822. Additionally, the mobile wagering game machine can include tilt, orientation, ambient light, or other environmental sensors.

In some embodiments, the mobile wagering game machine 800 uses the biometric device 806 for authenticating players, whereas it uses the display 816 and speakers 814 for presenting wagering game results and other information (e.g., credits, progressive jackpots, etc.). The mobile wagering game machine 800 can also present audio through the audio jack 808 or through a wireless link such as Bluetooth.

In some embodiments, the wireless communication unit 812 can include infrared wireless communications technology for receiving wagering game content while docked in a wager gaming station. The wireless communication unit 824 can include an 802.11 transceiver for connecting to and exchanging information with wireless access points. The wireless communication unit 824 can include a Bluetooth transceiver for exchanging information with other Bluetooth enabled devices.

In some embodiments, the mobile wagering game machine 800 is constructed from damage resistant materials, such as polymer plastics. Portions of the mobile wagering game machine 800 can be constructed from non-porous plastics which exhibit antimicrobial qualities. Also, the mobile wagering game machine 800 can be liquid resistant for easy cleaning and sanitization.

In some embodiments, the mobile wagering game machine 800 can also include an input/output ("I/O") port 830 for connecting directly to another device, such as to a peripheral device, a secondary mobile machine, etc. Furthermore, any component of the mobile wagering game machine 800 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method comprising:

generating a first task batch that includes tasks to configure a wagering game machine;

connecting to the wagering game machine via a computer network;

initiating a remote configuration session with the wagering game machine;

initiating execution of the first task batch remotely during the remote configuration session;

executing a first portion of the tasks in the first task batch for the wagering game machine;

determining that a second portion of the tasks in the first task batch fails to execute;

dynamically generating a second task batch that includes the second portion of the tasks and not the first portion of the tasks, in response to determining that the second portion of the tasks in the first task batch fails to execute; and in response to determining that the wagering game machine has been in an idle state for a pre-determined period of time, initiating execution of the second task batch remotely.

2. The method of claim 1 further comprising:

modifying a first set of files on the wagering game machine via the executing the first portion of the tasks;

modifying a second set of files on the wagering game machine when the second portion of the tasks in the first task batch fails to execute;

determining that the modifying the second set of files causes the wagering game machine to become inoperable;

determining that a restore of the second set of files of the first task batch would allow the wagering game machine to return to an operable state;

generating a third task batch with instructions to restore the second set of files and not restore the first set of files prior to executing the second portion of the tasks; and executing the third task batch remotely.

3. The method of claim 2 further comprising:

determining that the executing the third task batch causes the wagering game machine to return to an operable state; and delaying the initiating the execution of the second task batch for a regulatory idle period, the regulatory idle period being the pre-determined period of time.

4. The method of claim 1 further comprising:

determining that the wagering game machine becomes inoperable after the second portion of the tasks in the first task batch fails to execute; and dynamically generating the second task batch to include instructions to recover the wagering game machine to an operational state before initiating the execution of the second task batch remotely.

5. The method of claim 1, wherein dynamically generating the second task batch includes deleting the first portion of the tasks in the first task batch.

6. The method of claim 1 further comprising: storing the second task batch in a persistent data store;

setting a value in the persistent data store that indicates a first scheduled time for initiating the execution of the second task batch;

determining that initiating the execution of the second task batch, at the first scheduled time, would interfere with wagering game activity that occurs on the wagering game machine at the first scheduled time; and automatically modifying the value in the persistent data store so that the initiating the execution of the second task batch occurs after completion of the wagering game activity.

7. The method of claim 6 further comprising:

determining a timeout period for performing the second task batch;

determining an amount of time that transpires for the wagering game activity; and increasing the timeout period with the amount of time that transpires for the wagering game activity.

8. One or more non-transitory machine-readable storage media having instructions stored thereon, which when executed by a set of one or more processors causes the set of one or more processors to perform operations comprising:

connecting to a wagering game machine via a computer network during a remote configuration session, wherein the remote configuration session is initiated by a configuration server, and wherein the set of one or more processors are associated with the configuration server;

generating, remotely, a backup set of first configuration files for -the wagering game machine;

executing a configuration task batch remotely, wherein the configuration task batch includes instructions to overwrite the first configuration files with second configuration files that are updated versions of the first configuration files;

overwriting a first portion of the first configuration files with a first portion of the second configuration files in response to the executing the configuration task batch remotely;

determining a failure to overwrite a second portion of the first configuration files with a second portion of the second configuration files;

determining that the overwriting the first portion of the second configuration files on the wagering game machine does not interfere with an operational state of the wagering game machine; and remotely restoring the second portion of the first configuration files from the backup set and not restoring the first portion of the first configuration files.

9. The one or more non-transitory machine-readable storage media of claim 8, the operations further comprising:

dynamically modifying the configuration task batch to exclude the first portion of the second configuration files from the task batch, in response to determining that the overwriting the first portion of the second configuration files on the wagering game machine does not interfere with the operational state of the wagering game machine; and remotely re-executing the task batch to overwrite the second portion of the first configuration files and not overwrite the first portion of the first configuration files.

10. The one or more non-transitory machine-readable storage media of claim 8 said operations further comprising:

determining a duration spent remotely restoring the second portion of the first configuration files from the backup set;

determining a time out period for the configuration task batch; and automatically increasing the time out period with the duration.

11. The one or more non-transitory machine-readable storage media of claim 8 said operations further comprising:

determining a pre-determined idle period required before configuring the wagering game machine; and scheduling the configuration task batch to automatically re-execute after remotely restoring the second portion of the first configuration files from the backup set and after the pre-determined idle period.

12. The one or more non-transitory machine-readable storage media of claim 8, wherein the operation for remotely restoring the second portion of the first configuration files from the backup set includes operations comprising:

generating a recovery task batch that includes instructions to overwrite the second portion of the first configuration files with backup versions from the backup set of the first portion of the first configuration files, and exclude instructions to overwrite the first portion of the first configuration files.

13. The one or more non-transitory machine-readable storage media of claim 8, wherein generating the backup set of the first configuration files includes creating a first backup subset that includes the first portion of the first configuration files and a second backup subset that includes the second portion of the first configuration files, and wherein remotely restoring the second portion of the first configuration files from the backup set includes restoring the second backup subset and not restoring the first subset.

14. A system, comprising: an automated configuration server comprising a processor, a network interface configured to connect to a wagering game machine via a computer network during a remote configuration session, wherein the remote configuration session is initiated by the automated configuration server, a task generator configured to, via the processor, generate a first task to configure the wagering game machine, and generate a second task to configure a peripheral device associated with the wagering game machine, wherein the first task includes one or more first instructions to cause the wagering game machine to enter a temporary suspended state, and one or more second instructions configured to recognize the temporary suspended state of the wagering game machine, and delay execution of the second task on the wagering game machine until the temporary suspended state of the wagering game machine terminates, and a task controller configured to, via the processor, provide the first task and second task to the wagering game machine; and the wagering game machine comprising a processor configured to receive the first task and the second task, execute the first instructions from the first task, causing the wagering game machine to enter the temporary suspended state, execute the second instructions from the first task, causing the wagering game machine to delay execution of the second task until after the temporary suspended state terminates, and after termination of the temporary suspended state, execute the second task to configure the peripheral device.

15. The system of claim 14, wherein the automated configuration server is further configured to generate a third task configured to execute after the second task, determine an amount of time that transpires during the temporary suspended state, determine a timeout period for the third task, and automatically extend the timeout period for the third task with the amount of time that transpires during the temporary suspended state.

16. The system of claim 14, wherein the task generator is configured to generate the first task to install first wagering game content on the wagering game machine and reboot the wagering game machine, causing the wagering game machine to enter the temporary suspended state while rebooting, and generate the second task to install second wagering game content on the peripheral device.

17. The system of claim 14, wherein the task generator is further configured to determine a pre-determined waiting period required to wait between configuring the wagering game machine and configuring the peripheral device, and generate the first task to further delay execution of the second task on the wagering game machine until the temporary suspended state of the wagering game machine terminates and the pre-determined waiting period completes.

18. An apparatus comprising:

one or more processors; and an automated configuration module configured to, via use of the one or more processors, connect to a wagering game machine via a computer network during a remote configuration session, generate, remotely, a backup set of first configuration files for the wagering game machine, execute a configuration task batch remotely, wherein the configuration task batch includes instructions to overwrite the first configuration files with second configuration files that are updated versions of the first configuration files, overwrite a first portion of the first configuration files, via the executing the configuration task batch remotely, with a first portion of the second configuration files, determine a failure to overwrite a second portion of the first configuration files with a second portion of the second configuration files, determine that the overwriting the first portion of the second configuration files on the wagering game machine does not interfere with an operational state of the wagering game machine, generate a recovery task batch that includes instructions to overwrite the second portion of the first configuration files with backup versions from the backup set of the first portion of the first configuration files, and exclude instructions to overwrite the first portion of the first configuration files, remotely restore the second portion of the first configuration files from the backup set and not restore the first portion of the first configuration files using the recovery task batch, and remotely re-execute the task batch to overwrite the second portion of the first configuration files and not overwrite the first portion of the first configuration files.

19. The apparatus of claim 18, wherein the automated configuration module is further configured to dynamically modify the configuration task batch to exclude the first portion of the second configuration files from the task batch, in response to determining that the overwriting the first portion of the second configuration files on the wagering game machine does not interfere with the operational state of the wagering game machine.

20. The apparatus of claim 18, wherein the configuration task processor is further configured to determine a duration spent remotely restoring the second portion of the first configuration files from the backup set, determine a time out period for the configuration task batch, and automatically increase the time out period with the duration.

21. An apparatus comprising:

means for generating a first task batch that includes tasks to configure a wagering game machine;

means for connecting to the wagering game machine via a computer network;

means for initiating a remote configuration session with the wagering game machine;

means for initiating execution of the first task batch remotely during the remote configuration session;

means for performing, successfully, a first portion of the tasks in the first task batch for the wagering game machine;

means for determining that a second portion of the tasks in the first task batch fails to perform successfully;

means for dynamically generating a second task batch that includes the second portion of the tasks and not the first portion of the tasks, in response to determining that the second portion of the tasks in the first task batch fails to perform successfully;

means for determining a pre-determined idle period required before initiating execution of the second task batch;

means for scheduling the second task batch to automatically re-execute after the pre- determined idle period; and means for initiating execution of the second task batch remotely after the pre-determined idle period.

22. The apparatus of claim 21 further comprising:

means for modifying a first set of files on the wagering game machine via the performing the first portion of the tasks, wherein the means for modifying the first set of files does not cause the wagering game machine to become inoperable;

means for modifying a second set of files on the wagering game machine when the second portion of the tasks in the first task batch fails to perform successfully;

means for determining that the modifying the second set of files causes the wagering game machine to become inoperable;

means for determining that a restore of the second set of files of the first task batch would allow the wagering game machine to return to an operable state;

means for generating a third task batch with instructions to restore the second set of files and not restore the first set of files prior to performing the second portion of the tasks; and means for executing the third task batch remotely.

23. The apparatus of claim 21 further comprising:

means for determining that the wagering game machine becomes inoperable after the second portion of the tasks in the first task batch fails to perform successfully; and means for including in the second task batch instructions to recover the wagering game machine to an operational state before initiating the execution of the second task batch.

24. The apparatus of claim 21 further comprising means for scheduling the initiating the execution of the second task batch at a first scheduled time;

means for determining that initiating the execution of the second task batch, at the first scheduled time, would interfere with wagering game activity that occurs on the wagering game machine at the first scheduled time;

means for automatically re-scheduling the initiating the execution of the second task batch at a second scheduled time that is after completion of the wagering game activity; and means for initiating the execution of the second task batch remotely at the second scheduled time.

25. The apparatus of claim 24 further comprising:

means for determining a timeout period for performing the second task batch;

means for determining an amount of time that transpires for the wagering game activity; and means for increasing the timeout period with the amount of time that transpires for the wagering game activity.

* * * * *